US010352139B2

(12) United States Patent
Acorda et al.

(10) Patent No.: US 10,352,139 B2
(45) Date of Patent: Jul. 16, 2019

(54) COILED TUBING THROUGH PRODUCTION TUBING ZONE ISOLATION AND PRODUCTION METHOD

(71) Applicant: BAKER HUGHES, A GE COMPANY, LLC, Houston, TX (US)

(72) Inventors: Edgar Acorda, Metro Manila (PH); Ronald P. Ramnarine, Kuala Lumpur (MY); Waqas Munir, Rawalpindi/Islamabad (PK)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 669 days.

(21) Appl. No.: 14/950,903

(22) Filed: Nov. 24, 2015

(65) Prior Publication Data

US 2016/0186538 A1 Jun. 30, 2016

Related U.S. Application Data

(60) Provisional application No. 62/090,734, filed on Dec. 11, 2014.

(51) Int. Cl.

| | |
|---|---|
| ***E21B 29/00*** | (2006.01) |
| ***E21B 33/127*** | (2006.01) |
| ***E21B 43/14*** | (2006.01) |
| ***E21B 33/124*** | (2006.01) |

(52) U.S. Cl.

CPC ..... *E21B 43/14* (2013.01); *E21B 33/124* (2013.01)

(58) Field of Classification Search

CPC .... E21B 33/124; E21B 43/14; E21B 33/1243; E21B 33/122

See application file for complete search history.

(56) References Cited

U.S. PATENT DOCUMENTS

| | | | | |
|---|---|---|---|---|
| 5,400,856 | A * | 3/1995 | Schmidt | E21B 43/116 166/271 |
| 5,503,014 | A * | 4/1996 | Griffith | E21B 17/203 166/250.17 |
| 5,957,198 | A * | 9/1999 | Haynes | E21B 17/07 166/250.03 |
| 2008/0164027 | A1* | 7/2008 | Sanchez | E21B 43/04 166/278 |
| 2009/0159275 | A1* | 6/2009 | Kannan | E21B 33/1243 166/250.17 |
| 2010/0000727 | A1* | 1/2010 | Webb | E21B 34/14 166/135 |

(Continued)

*Primary Examiner* — Daniel P Stephenson
(74) *Attorney, Agent, or Firm* — Shawn Hunter

(57) ABSTRACT

An existing well has zones that respectively produce water and desired fluids. Existing production tubing is in the well to a location uphole of the producing zones and preferably in a lateral portion on the borehole. The water producing zone is between the surface and the productive zone. A coiled tubing string with a straddle assembly of inflatable isolation packers is run through the production string. An optional milling out of the lower end of the production string can take place first. The inflatable straddle assembly is run past the end of the production string for placement to straddle the water zone while allowing production from the productive zone. The coiled tubing serves as the new production tubing for the productive zone. One or more zones can be isolated or aligned for flow from productive zones.

12 Claims, 3 Drawing Sheets

(56) References Cited

U.S. PATENT DOCUMENTS

| | | | | |
|---|---|---|---|---|
| 2010/0108313 | A1* | 5/2010 | Chan | E21B 17/20 166/263 |
| 2010/0276160 | A1* | 11/2010 | Tolman | E21B 33/10 166/386 |
| 2010/0300687 | A1* | 12/2010 | Watson | E21B 34/06 166/278 |
| 2011/0247878 | A1* | 10/2011 | Rasheed | E21B 10/32 175/50 |
| 2014/0014337 | A1* | 1/2014 | Stringfield | E21B 43/04 166/278 |
| 2014/0341755 | A1* | 11/2014 | Laing | E21B 43/121 417/53 |
| 2014/0360724 | A1* | 12/2014 | Laird | E21B 31/002 166/301 |
| 2015/0356403 | A1* | 12/2015 | Storm, Jr. | G06N 3/08 706/12 |
| 2016/0115770 | A1* | 4/2016 | Kent | E21B 43/26 166/305.1 |
| 2016/0138360 | A1* | 5/2016 | Dolog | E21B 33/124 166/250.01 |
| 2016/0186538 | A1* | 6/2016 | Acorda | E21B 43/14 166/313 |

* cited by examiner

COILED TUBING THROUGH PRODUCTION TUBING ZONE ISOLATION AND PRODUCTION METHOD

CROSS REFERENCE TO RELATED APPLICATION

This application is claims priority from U.S. Provisional Patent Application Ser. No. 62/090,734, filed on Dec. 11, 2014, the disclosure of which is incorporated herein by reference in its entirety.

FIELD OF THE INVENTION

The field of the invention is zonal isolation in existing wells and more particularly zonal isolation with a bottom hole assembly going through the production tubing and straddling the offending zone with inflatables while producing through the coiled tubing.

BACKGROUND OF THE INVENTION

Highly deviated wells that have multiple zones from which production can take place sometimes experience water or other undesirable fluids from one zone when an adjacent zone is still viable and produces the desired fluids. In some instances the production tubing stops short in the horizontal portion of the well before all the producing zones. If the deeper zone is producing the desired fluids then the shallower zone needs to be isolated while the deeper zone allowed to produce. In situations where the production tubing is in the well and cannot be removed, there is a need for a solution of how to produce the deeper zone while isolating the shallower zone without taking the production tubing and associated isolation devices out of the well.

The present invention addresses this situation. It entails initially milling out the lower end of the production tubing equipment so that a bottom hole assembly run on coiled tubing can be advanced fully through the production tubing and into position at the zones in question. Preferably, inflatable packers are spaced apart to straddle the upper zone that was producing water or other undesirable fluids while allowing production from the deeper zone that is past the straddle while using the coiled tubing to produce the desired zone to the surface. One or more zones can be isolated with a straddle of spaced packers thus allowing the well to be placed back into service. These and other features of the invention will be more readily apparent to those skilled in the art from a review of the detailed description of the preferred embodiment and the associated drawings while recognizing that the full scope of the invention can be determined from the appended claims.

SUMMARY OF THE INVENTION

An existing well has zones that respectively produce water and desired fluids. Existing production tubing is in the well to a location uphole of the producing zones and preferably in a lateral portion on the borehole. The water producing zone is between the surface and the productive zone. A coiled tubing string with a straddle assembly of inflatable isolation packers is run through the production string. An optional milling out of the lower end of the production string can take place first. The inflatable straddle assembly is run past the end of the production string for placement to straddle the water zone while allowing production from the productive zone. The coiled tubing serves as the new production tubing for the productive zone. One or more zones can be isolated or aligned for flow from productive zones.

DETAILED DESCRIPTION OF THE PREFERRED EMBODIMENT

Figure 1:
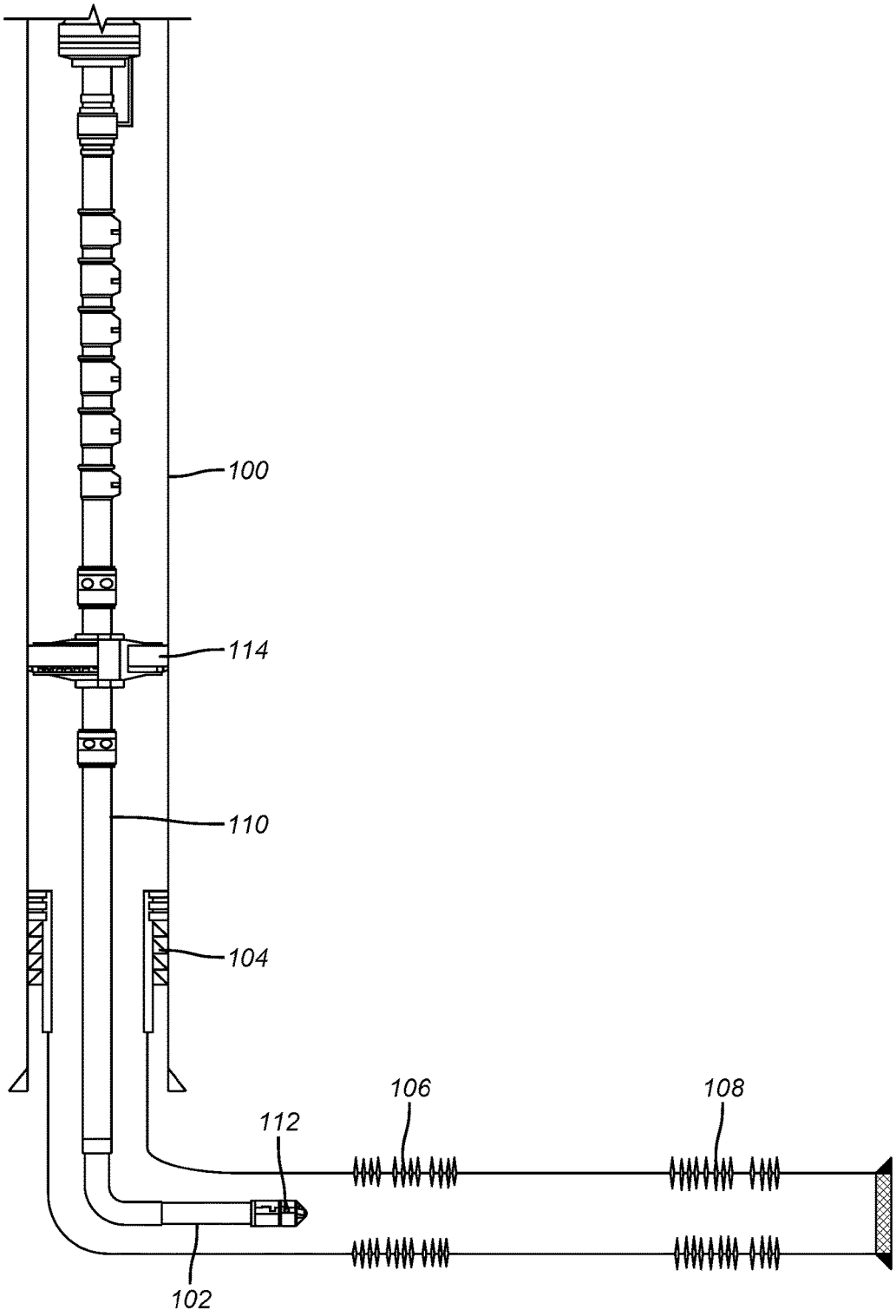
FIG. 1 is a schematic depiction of a multi-zone horizontal well with existing production tubing extend to above the producing zones.
Figure 2:
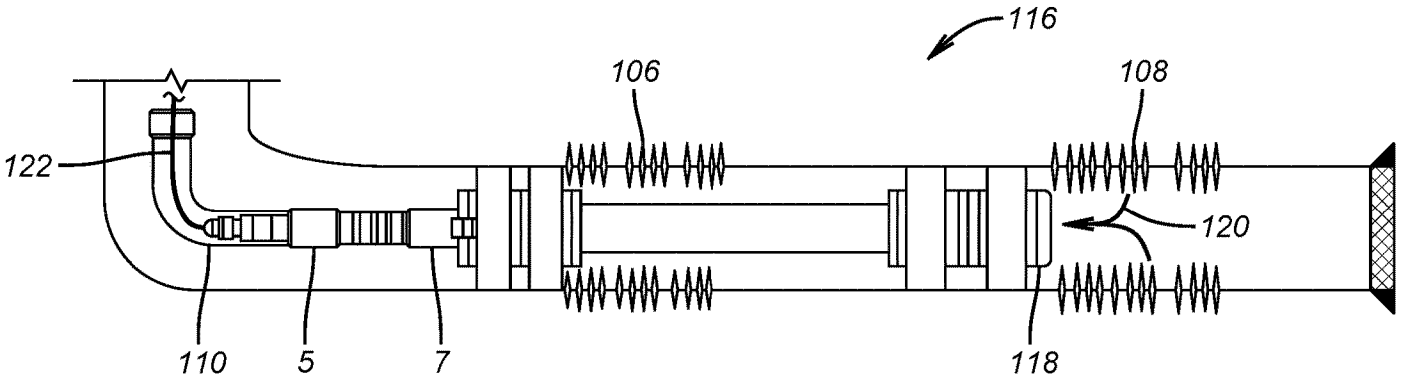
FIG. 2 shows a coiled tubing run straddle assembly in position to isolate one zone and produce from an adjacent zone.

FIG. 1 shows surface casing 100 with liner 102 suspended at hanger 104. Zones 106 and 108 are shown in a nearly horizontal run. Zone 106 is closer to the surface and is producing water while zone 108 is still viable and produces desired fluids. A production string 110 extends to above zone 106 and has a lower end plug or other obstruction 112. A production packer 114 is in the surface casing 100. The plan is to produce zone 108 while isolating zone 106 and to that through the production tubing 110 that will remain in place. The method of doing so is to run a bottom hole assembly 116 as shown in FIG. 2 so that zone 106 is straddled and zone 108 produces from end 118 as indicated by arrow 120. Seals 5 and 7 seal to the inside of the production tubing 110 and are supported from coiled tubing string 122 as better seen in FIG. 5.

Figure 5:
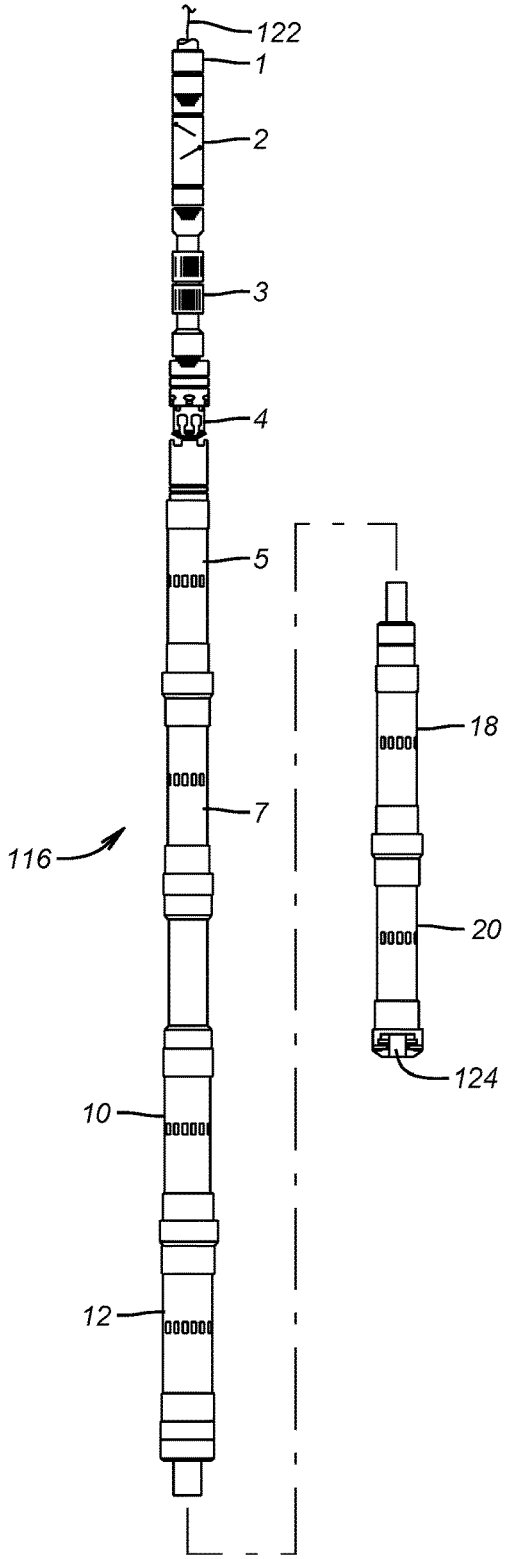
FIG. 5 is a detailed view of one straddle assembly to be run on coiled tubing.

FIG. 5 shows inflatables 18 and 20 spaced from inflatables 10 and 12. When properly placed these spaced apart pairs of inflatables will straddle zone 106 to isolate it. Packers 5 and 7 can be optionally used inflatables that seal against the production string 110 and serve as backup to inflatables 10 and 12. At the top of the illustrated bottom hole assembly 116 are a coiled tubing connector 1, a double flapper check valve 2, another connector 3 and a hydraulic disconnect 4. After the inflatables are all set using a ball dropped on a shearable seat of a type well known in the art a passage 124 is opened up at the low end of the bottom hole assembly 116 as a result of blowing through the balls and seats or removing them in other ways like dissolving or disintegrating.

Figure 3:
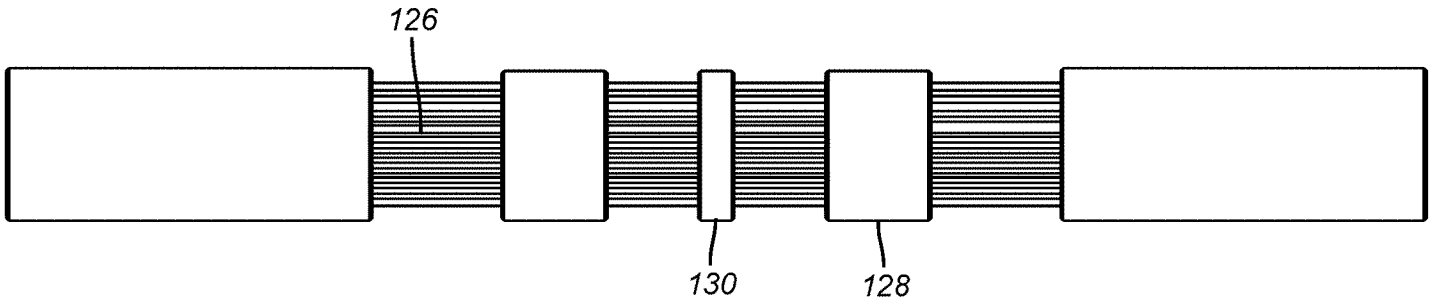
FIG. 3 is a detailed view of an inflatable isolator as shown in FIG. 2.

FIG. 3 shows a detailed view of the through tubing inflatables shown in FIG. 5. They feature overlapping folds 126 with surrounding seals 128 and anchor bands 130 to enhance the sealing and anchoring capabilities of the inflatables shown in FIG. 5. Alternatively, swelling packers can be used or shape memory alloy sealing elements that above their critical temperature enlarge into a sealing position. Another option is opposed packer cups. The materials of construction need to be compatible with the anticipated chemical composition of the well fluids. Chrome or polyvinylchloride or polymer liners can also be used.

Figure 4:
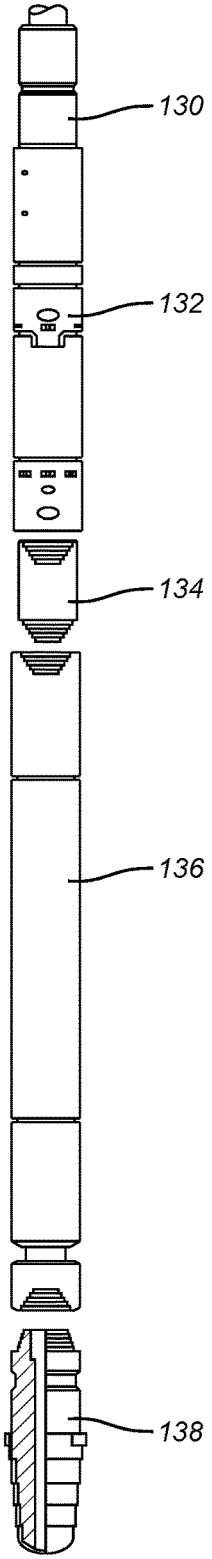
FIG. 4 is a milling bottom hole assembly that can be run on coiled tubing to open up the production tubing lower end before insertion of the straddle assembly.

FIG. 4 shows the bottom hole assembly to enlarge the opening at the lower end 112 of the production tubing 110 before running in the bottom hole assembly 116 through the lower end 112 of the production tubing 110. The FIG. 4 milling bottom hole assembly features a connector 130, an MHA 132, a crossover 134, the progressing cavity Moineau motor 136 and the mill 138. The milling allows a larger drift dimension so that the size of the bottom hole assembly 116 can be as large as possible.

Those skilled in the art will now appreciate that the method illustrated allows zone isolation through production tubing and continued production from one or more remaining productive zone through coiled tubing. One or more zones that are producing water can be isolated regardless of whether they are adjacent or spaced on opposed sides of producing zones. Each straddle assembly can have sliding sleeve valves for selective access to any previously isolated zone or into zones that need to be aligned for continuing production. As an alternative option the coiled tubing in the straddled zone can be pre-perforated with rupture discs in the perforations to provide selective access to a straddled zone. The isolation devices can also be customized to maximize the internal dimension so as to minimally restrict flow therethrough while still having a small enough drift dimension to fit through the existing production tubing 110.

The above description is illustrative of the preferred embodiment and many modifications may be made by those skilled in the art without departing from the invention whose scope is to be determined from the literal and equivalent scope of the claims below:

We claim:

1. A method of isolating one zone while flowing through another zone in an existing wellbore, comprising:

running in a string extending through spaced isolators through existing production tubing;

positioning and actuating said isolators for sealing above and below a first zone located beyond the exiting production string;

allowing flow through said string from one of said first and a second zone from beyond or between said isolators;

isolating flow from one of said first or second zones with said isolators;

removing a bottom hole assembly from the production tubing before running in said string.

2. The method of claim 1, comprising:

milling out said bottom hole assembly on the production string for removal thereof.

3. The method of claim 1, comprising:

using coiled tubing as said string.

4. The method of claim 1, comprising:

leaving the production tubing in position when running in said string and isolators through the production tubing.

5. The method of claim 4, comprising:

milling out the bottom hole assembly for said removing.

6. The method of claim 1, comprising:

providing for said isolators at least one of an inflatable, a swelling packer, or a packer cup.

7. The method of claim 6, comprising:

taking flow from an end of said string located beyond said isolators.

8. The method of claim 7, comprising:

using coiled tubing as said string.

9. A method of isolating one zone while flowing through another zone in an existing wellbore, comprising:

running in a string extending through spaced isolators through existing production tubing;

positioning and actuating said isolators for sealing above and below a first zone located beyond the existing production string;

allowing flow through said string from one of said first and a second zone from beyond or between said isolators;

isolating flow from one of said first or second zones with said isolators;

providing at least one seal externally on said string for sealing to said production tubing;

providing for said isolators at least one of an inflatable, a swelling packer, or a packer cup;

taking flow from an end of said string located beyond said isolators;

using coiled tubing as said string;

leaving the production tubing in position when running in said coiled tubing and isolators through the production tubing.

10. The method of claim 9, comprising:

removing a bottom hole assembly from the production tubing before running in said string.

11. The method of claim 10, comprising:

milling out said bottom hole assembly on the production string for removal thereof.

12. The method of claim 9, comprising:

milling out the bottom hole assembly for said removing.

* * * * *